United States Patent [19]

Merkle

[11] 4,016,379

[45] Apr. 5, 1977

[54] LOCK FOR SAFETY CUT-OUT SWITCHES

[76] Inventor: Paul Merkle, Eschenbrunnlestr. 48, 7032 Sindelfingen, Germany

[22] Filed: June 11, 1975

[21] Appl. No.: 585,777

[30] Foreign Application Priority Data

June 12, 1974 Germany ..... 2428456
June 12, 1974 Germany ..... 2428458

[52] U.S. Cl. ..... 200/44; 70/365; 70/387

[51] Int. Cl.[2] ..... H01H 27/00

[58] Field of Search ..... 200/44, 50 A, 50 AA, 200/50 C, 50 B, 42 R, 42 T, 42 A; 70/365, 387, 345

[56] References Cited

UNITED STATES PATENTS 1,730,683 10/1929 Philbrick et al. ..... 200/42 R

*Primary Examiner*—Gene Z. Rubinson
*Assistant Examiner*—Morris Ginsburg

[57] ABSTRACT

In a system without longitudinally slidable inserts, a main lever is actuated by a canted notch on a key to swivel in one direction to lock the switch and to swivel by gravity in the reverse direction. A blocking lever is actuated in one direction by the tip of the key and in the opposite direction by a spring.

The main lever and the blocking lever are arranged to cooperate with each other whereby the main lever is blocked by the blocking lever when the switch is locked and the blocking lever is blocked by the main lever when the switch is unlocked.

14 Claims, 9 Drawing Figures

LOCK FOR SAFETY CUT-OUT SWITCHES

The subject matter of the invention is a single key lock for a safety cut-out switch (for electrical lines) that has no longitudinally slideable lock insert but only levers which are arranged to swivel, the forward upper end of one lever engaging in a notch of the switch toggle disk and thus blocking the rotation of the latter.

A longitudinally slideable lock insert is not needed in this lock because two levers are used which mutually block each other in the two lever end positions whereby, on the one hand, the main lever is blocked by the blocking lever when the key is withdrawn and, on the other hand, the blocking lever is blocked by the main lever when the key is inserted.

In exploitation of this principle the main lever is designed with regard to its motion transmission and the transition cant of the key notch on the key tip is used for releasing this travel stop mechanism. In one form of this invention, the blocking lever is a hooked lever and a third lever, which is not absolutely necessary, enables the overall height of the lock to be reduced. If this lever is not used the blocking lever must have an appropriately long leg for the spring of this lever. The fixed hanger point of the spring in this embodiment is located at the right-hand (rear) of the lock.

In a modified form, the main lever is supported at the front, i.e. it is arranged inversely, and that the third lever, i.e. the spring travel shift lever, is not used because the spring is directly hooked in on the blocking lever. A further difference over the lock according to the first form consists in that an additional intermediate lever between lock and switch is not needed and that the function of said intermediate lever is taken over by an upward extension of the main lever, the forward tongue of said extension locking the switch toggle disk in a sufficiently horizontal direction of motion.

The inverse arrangement of the main lever has the advantage that firstly its locking travel at the blocking lever becomes sufficiently large and that secondly, as already mentioned, an additional intermediate lever for locking the switch toggle disk is not required. Another difference of this lock over the lock according to the first form is that the main lever is provided with a roller which reduces the frictional resistance and wear.

The lock is represented on FIGS. 1 through 9.

Figure 1:
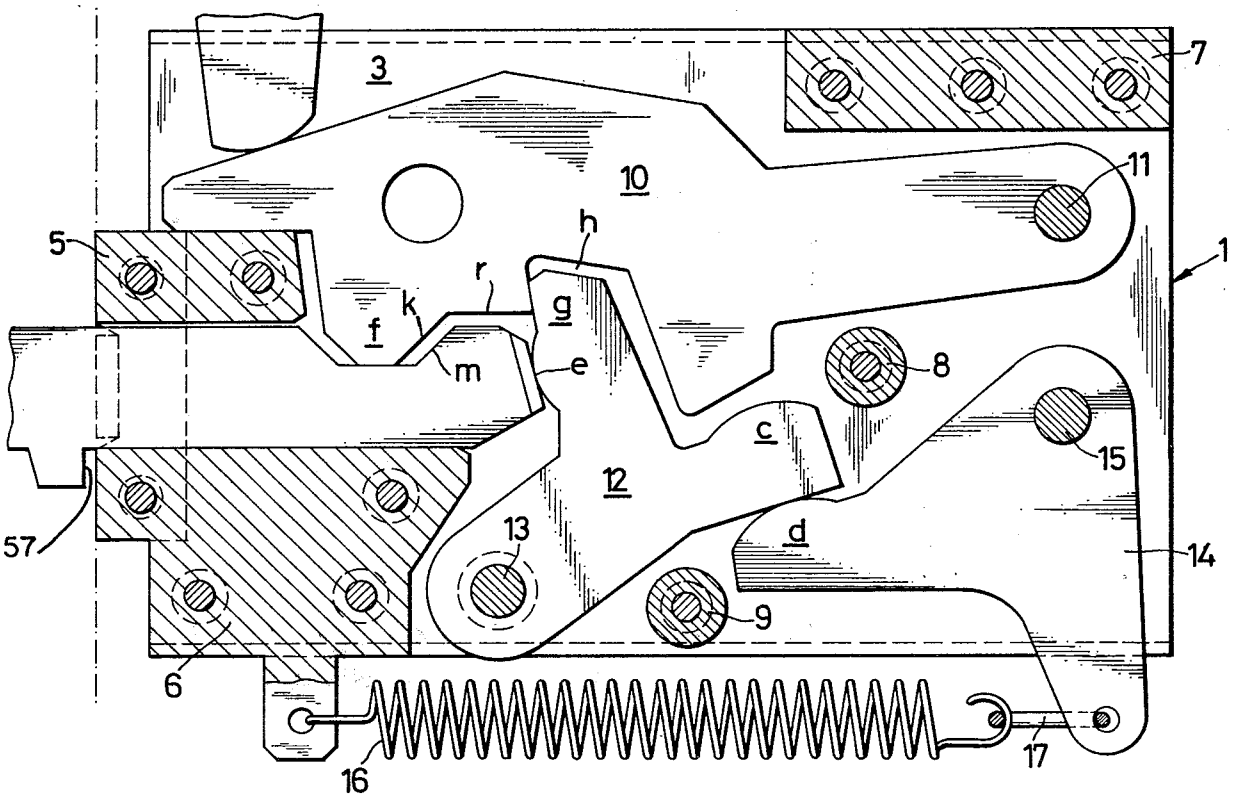
FIG. 1 is a vertical longitudinal section showing the key, main lever, blocking lever, shift lever and the forward lower end of the intermediate lever supported in the switch housing.
Figure 2:
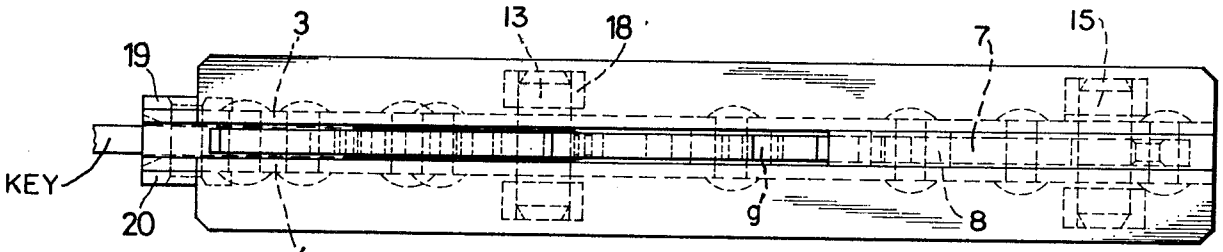
FIG. 2 is the plan view of the lock corresponding to FIG. 1.
Figure 5:
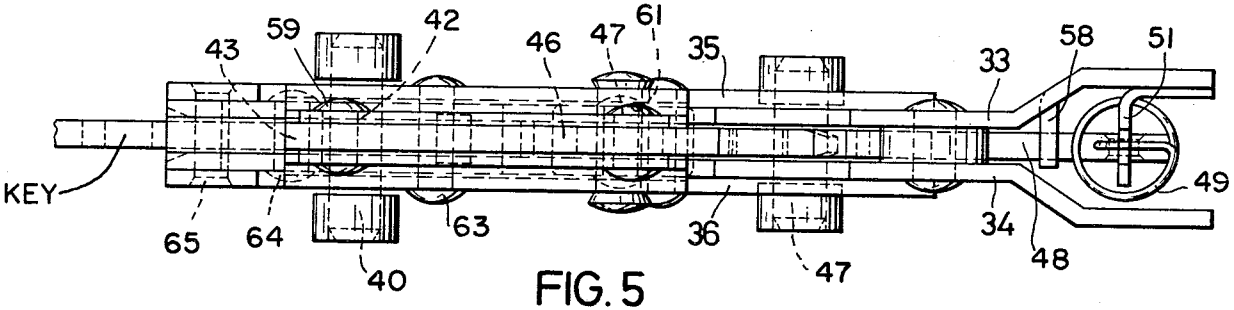
FIG. 5 is a plan view of the lock corresponding to FIG. 4.
Figure 3:
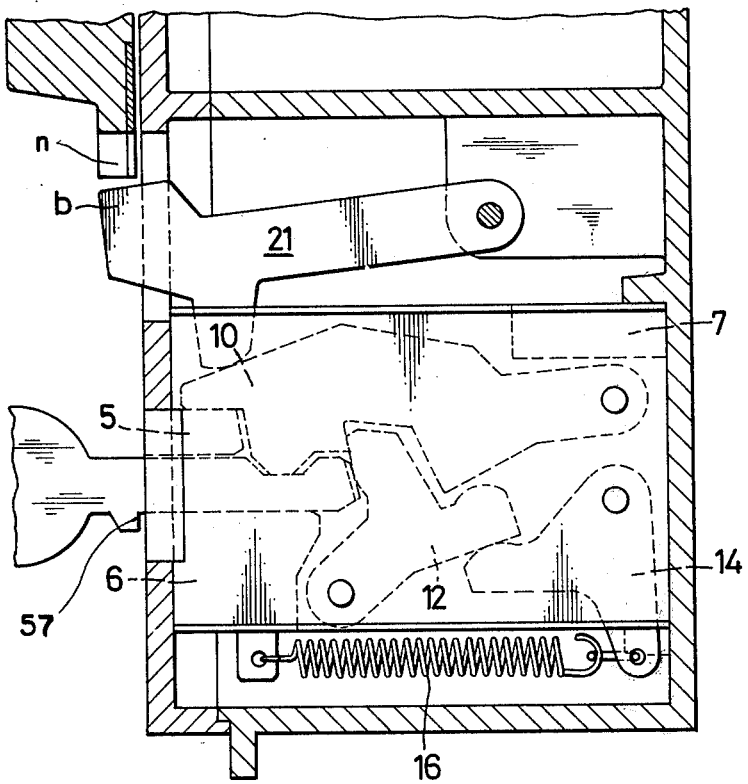
FIG. 3 is the vertical longitudinal section through the lower portion of the switch housing of the lock according to FIG. 1.
Figure 4:
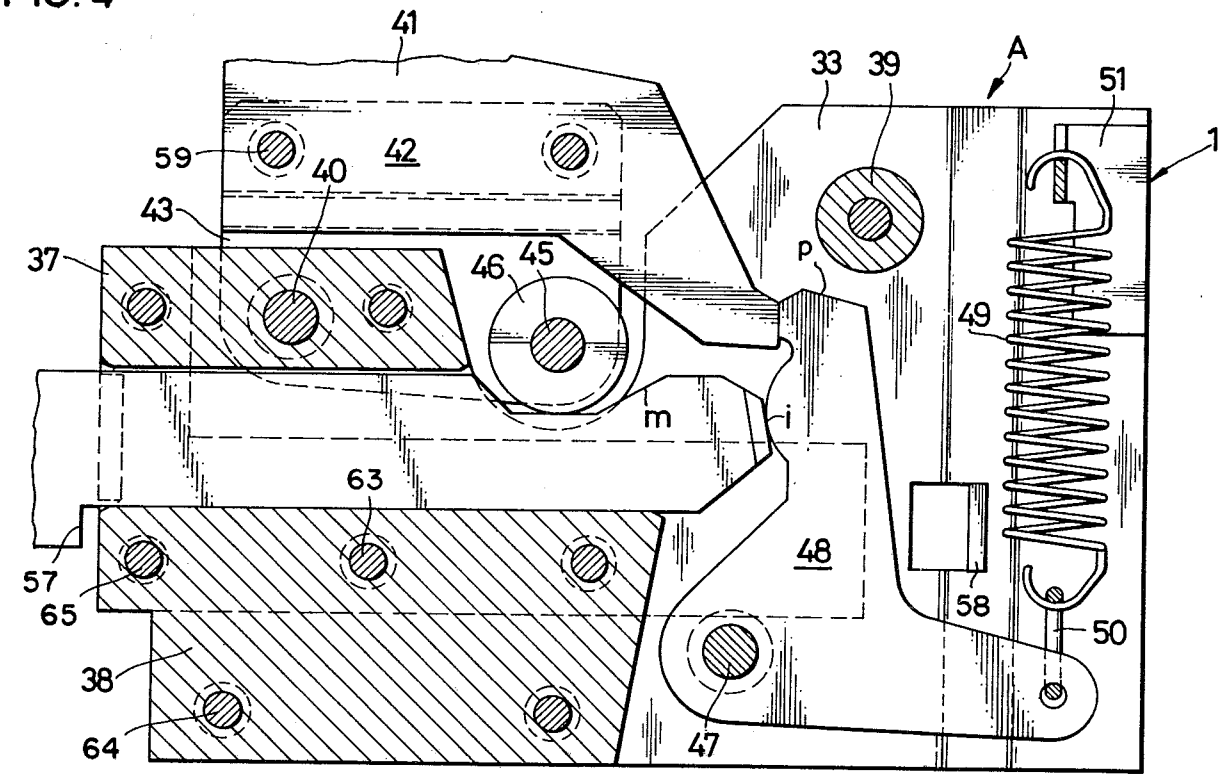
FIG. 4 is a vertical longitudinal section of a modified version A showing the key, the center portion of the main lever, the roller of the main lever, and the blocking lever.
Figure 6:
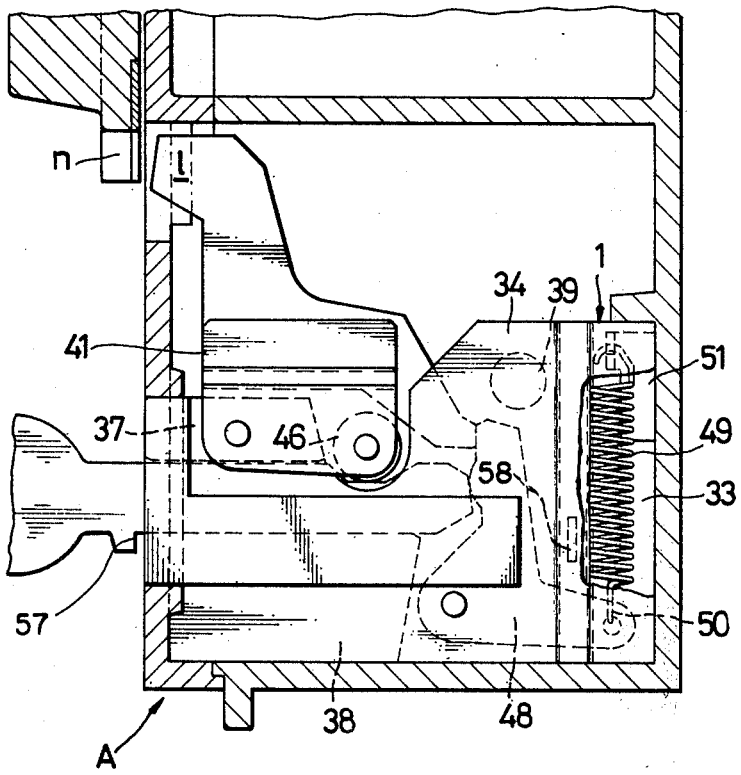
FIG. 6 is the vertical longitudinal section through the lower portion of the switch housing of the lock according to FIG. 4.

Referring to FIGS. 1 to 3: on the one hand, the lock consists of the housing 1 which is composed of two side plates 3 and 4 with rectangularly bent top and bottom edges and the intermediate pieces 5 through 7 as well as the spacer disks 8 and 9 and, on the other hand, of the moving parts: main lever 10 with bearing bolt 11, blocking lever 12 with bearing bolt 13, shift lever 14 with bearing bolt 15 and tension spring 16 with double hook 17. The bearing bolts 11, 13 and 15 are also fixed in the housing. The side plates 3 and 4 are riveted together through the intermediate pieces 5 through 7 or they are connected by means of resistance spot welding. The bearing bolts 11, 13 and 15 are retained by pressed on bushings 18 so that they cannot drop out. In addition, the lock housing is provided with two reinforcing plates 19 and 20 at its forward end.

The mode of action of the lock is as follows: before the introduction of the key the main lever 10, due to the action of the tension spring 16 transmitted via the tongues *c* and *d* of the levers 12 and 14, is in its extreme clockwise swivel position in which its tongue *f* has left the zone of the key space with a sufficient distance; the blocking lever 12 is in its extreme anti-clockwise swivel position in which its tongue *g* is blocking the main lever 10 against an anti-clockwise swivel movement. Now, when the key is introduced, the key tip comes into contact with point *e* of the blocking lever 12 whereby, upon further introduction of the key, the tongue *g* of blocking lever 12 enters the zone of the hooked notch *h* of the main lever 10 which, upon termination of the key inward movement, under the action of its own gravity and of the gravity of the intermediate lever 21, swivels anti-clockwise and snaps into the position in which it is represented in the drawing and in which, consequently, the intermediate lever 21 is also in the position where its tongue *b* has left the notch of the switch toggle disk. Thus, the switch is unlocked and can be actuated. It is noted the key actuates the blocking lever 12 and the main lever 10 by translational movement with respect to the lock housing 1. The key is not rotated.

Locking of the switch, which is only possible in the switched off position, is then effected by withdrawing the key again. With this, edge *m* of the key is bearing against edge *k* of the main lever 10 whereby the latter, in the course of the further outward movement of the key, is swivelled clockwise, thus unlocking the blocking lever 12 on the main lever 10. By that the blocking lever 12, which is loaded by the tension spring 16 via the shift lever 14, is free to swivel anti-clockwise, whereby its tongue *c* swivels the main lever 10 further in the clockwise direction. After the clockwise swivel end position has been attained, both the switch and the main lever are locked again as now the tongue *b* of the intermediate lever 21 has re-engaged in the notch *n* of the switch toggle disk and the tongue *g* of the blocking lever 12 now again is facing the edge *r* of the main lever 10.

Referring to FIGS. 4 to 9: the locks of the modified versions A, B and C differ from one another only by different switch toggle disk blocking levers and/or locking mechanisms. The lock of the version A, on the one hand, consists of the housing 1 which is composed of two side plates 33 and 34 with the stiffening plates 35 and 36, the intermediate pieces 37 and 38 and the spacer disk 39 and, on the other hand, of the moving parts: the main lever 41 arranged to swivel about the bearing bolt 40, comprising the parts 42, 43, bearing bolt 45 and roller 46, furthermore the blocking lever 48 arranged to swivel about the bearing bolt 47 with the tension spring 49 and double hook 50.

For the purpose of enlarging the interspace, the housing side plates have a double oblique angle-shaped form at their rear ends and are held together by rivets. The components of the main lever 41 are connected to each other by rivets 59 and 63. Component 51 is the retaining bracket for the tension spring 49. The stiffening plates 35 and 36 are connected to the side plates 33 and 34 by resistance spot welding. The anti-clockwise swivel movement of the blocking lever 48 is limited by stop 58. The housing side plates 33 and 34 can also be connected through the intermediate pieces 37 and 38 by resistance spot welding.

The mode of action of the lock is as follows: before the introduction of the key both the main lever 41 and the blocking lever 48 are in their anti-clockwise swivel end positions, in which the roller 46 of the main lever 41 has left the key zone and the blocking lever 48 blocks the main lever 41 against a clockwise swivel movement by means of its edge *p*. Now, when the key is being introduced, the key tip first contacts point *i* of the blocking lever 48 whereby the latter, upon further introduction of the key, is swivelled clockwise against the action of tension spring 49 and thus leaves the zone of motion of the main lever. This inward movement of the key is terminated when edge 57 of the key bears against the lock forward edge and the main lever 41, due to the action of its gravity and/or the action of its gravity and of an additionally arranged tension spring, thereby snaps into the position in which it is represented in the drawing and in which tongue *l* of the main lever 41 has left notch *n* of the switch toggle disk. Thus, the switch is unlocked and can be actuated.

Locking of the switch, which is only possible in its switched off position, is then effected by withdrawing the key again. This first causes the edge *m* of the key to bear against the roller 46 whereby the main lever 41 in the course of the further outward movement of the key, is swivelled anti-clockwise and the blocking lever 48 being interlocked with the main lever 41 is unlocked. Thus, the blocking lever 48, being loaded by tension spring 49, is free to swivel anti-clockwise and blocking lever 48 snaps into its anti-clockwise swivel end position in which it, in turn, is blocking the main lever 41 against a clockwise swivel movement. By that, both the switch and the main lever are locked again, as tongue *l* of the main lever 41 is now again in notch *n* of the switch toggle disk and the main lever, in turn, is blocked by edge *p* of the blocking lever against a clockwise swivel movement.

Figure 7:
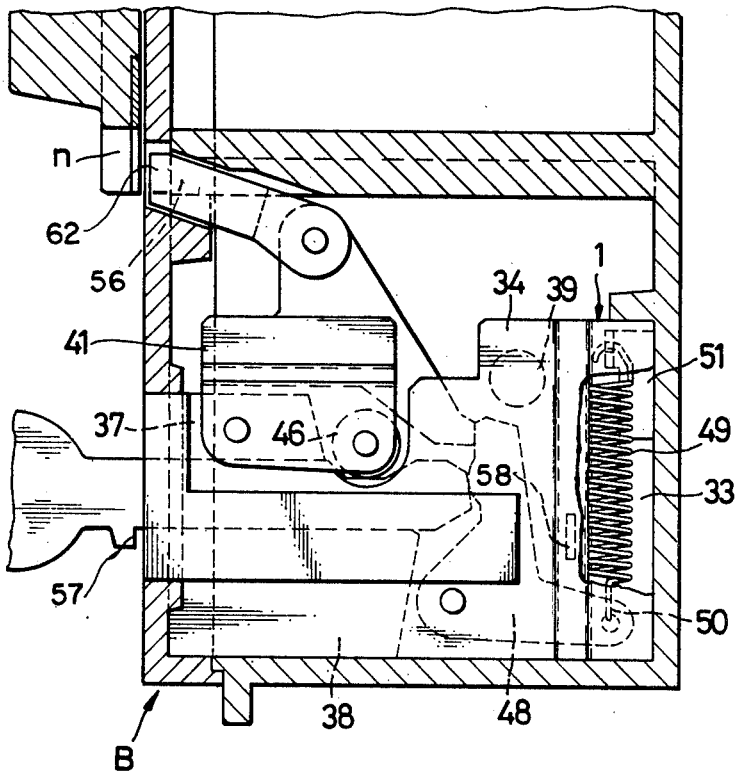
FIG. 7 shows the same section with a lock of a further modified version B.

The modified version B of this lock represented in FIG. 7 differs from version A only in that the main lever 41 is provided at its upper end with a latch 56 which is arranged to swivel and whose forward end 62 locks the switch toggle disk. For design reasons the latch 56 is arranged in an oblique position which has the additional advantage of a reduction of the required switch toggle disk diameter. If necessary, the main lever of this lock version can also be loaded by a weak tension spring with a clockwise swivel action.

Figure 8:
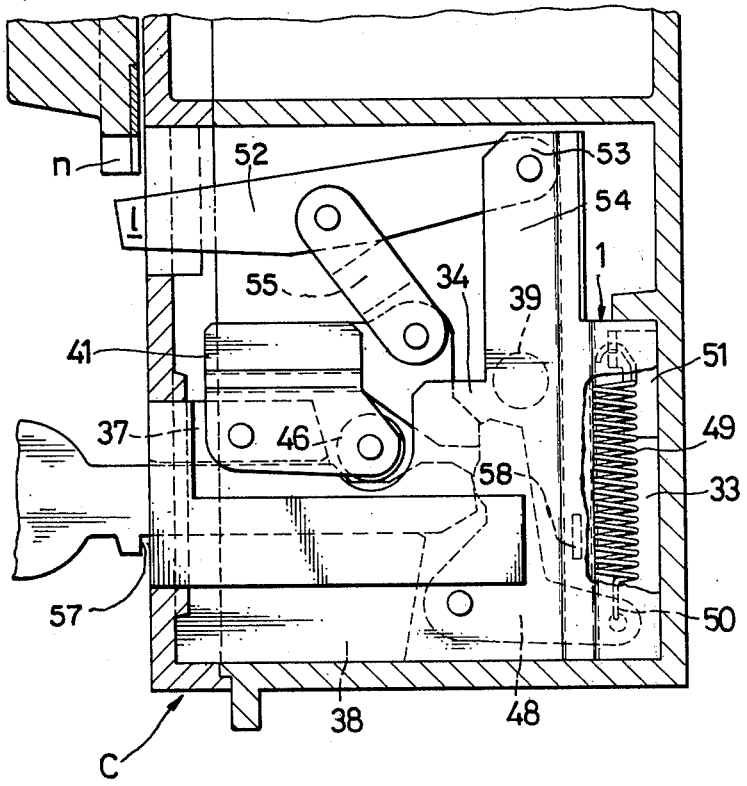
FIG. 8 shows the same section with a lock of a further modified version C.

The modified version C of this lock which is represented in FIG. 8 is provided with a horizontally arranged switch blocking lever 52 which, at its rear end 53, is supported to swivel on an extension 54 of the lock housing side plates and which is actuated by the main lever 41 through a double jointed intermediate piece 55. The mode of action of this auxiliary lever arrangement can be seen from the drawing: when the main lever swivels in the anti-clockwise direction the forward (left) end of the switch blocking lever moves upward and when the main lever swivels in the clockwise direction the switch blocking lever moves downward.

Figure 9:
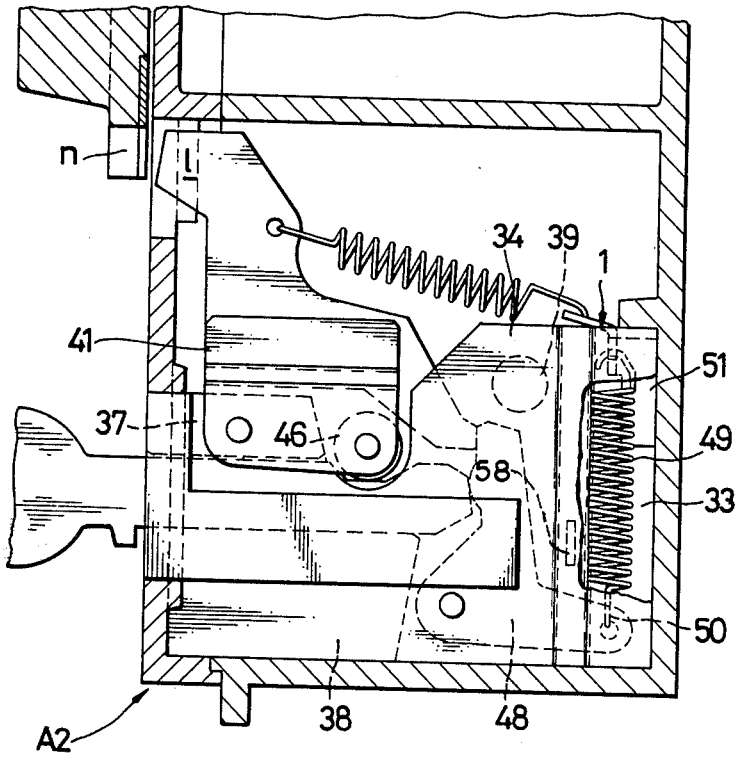
FIG. 9 shows the same section with a lock of a further modified version A 2.

The modified version A 2 of this lock which is represented in FIG. 9 differs from version A only in that the main lever 41 is loaded by a weak tension spring tending to swivel said lever in the clockwise direction (the mode of action of this spring has already been described.)

What is claimed is:

1. A lock for a safety cut-out switches comprising
   - a lock housing,
   - a locking member within said housing engageably cooperating with the cut-out of the switch to lock the switch in a desired operational condition,
   - a main lever within said housing pivotally arranged to move said locking member to its locked position and having a motion tongue thereon,
   - a blocking lever within said housing pivotally arranged and spring loaded to block the motion of said main lever when said main lever is in its locking position,
   - said main lever being further arranged to block the rotation of said blocking lever when said main lever is in its unlocking position,
   - said blocking lever having shaped portions thereon which control the unlocking movement of said main lever with the pivotal motion of said blocking lever, and
   - a key which actuates the pivotal movement of said main lever and said blocking lever by translation movement with respect to said lock housing,
   - said key having a notch thereon cooperating with said motion tongue on said main lever to lock said key in a position corresponding to the non-locked state of the lock.

2. A lock for safety cut-out switches according to claim 1 in which the main lever is relatively short, its pivot axis being located at the front part of the housing, said motion tongue being arranged to be actuated by said key notch, said main lever having a locking tongue facing the blocking lever which is adequately spaced behind its motion tongue to provide sufficiently long locking travel of the main lever on the blocking lever.

3. A lock for safety cut-out switches according to claim 2 in which said motion tongue of the main lever comprises a roller arranged on the main lever.

4. A lock for safety cut-out switches according to claim 1 wherein said locking member comprises an upwardly extending leg on said main lever and the switches are provided with a switch toggle disk which has a notch into which said upwardly extending leg on the main lever may engage to lock the switch toggle disc in the "off" position of the switches.

5. A lock for safety cut-out switches according to claim 1 wherein said main lever is of a three-layer design.

6. A lock for safety cut-out switches according to claim 1 comprising spring means for directly spring loading said blocking lever.

7. A lock for safety cut-out switches according to claim 6, comprising a pair of side plates which are angle-shaped in the vicinity of said spring means.

8. A lock for safety cut-out switches according to claim 1 wherein the locking member comprises latch means arranged to swivel on the main lever for locking said switches.

9. A lock for safety cut-out switches according to claim 1 wherein the locking member comprises an intermediate jointing means and a substantially horizontally arranged lever means coupled to the main lever by the aid of said intermediate jointing means.

10. A lock for safety cut-out switches according to claim 1 in which the key notch has a canted edge and the main lever is arranged to pivot in the direction towards the key notch by gravity and in the opposite direction to lock the switch through the canted notch edge of the key.

11. A lock for safety cut-out switches according to claim 1 in which the blocking lever is actuated in one direction to unblock the main lever by the tip of the key, said blocking lever being spring-loaded in the opposite direction.

12. A lock for safety cut-out switches according to claim 1 comprising a tongue on the blocking lever which pivots the main lever into an extreme upper position under the loading of a spring.

13. A lock for safety cut-out switches according to claim 12 comprising a shift lever for transmitting the loading from the spring to the blocking lever.

14. A lock for safety cut-out switches according to claim 12 comprising spring means connected to said blocking lever for directly loading said blocking lever.

* * * * *